US009322621B2

(12) United States Patent
Cohen

(10) Patent No.: US 9,322,621 B2
(45) Date of Patent: Apr. 26, 2016

(54) ARMOR SYSTEM

(75) Inventor: Hananya Cohen, New York, NY (US)

(73) Assignee: Edan Administration Services (Ireland) Limited, Dublin (IE)

( * ) Notice: Subject to any disclaimer, the term of this patent is extended or adjusted under 35 U.S.C. 154(b) by 17 days.

(21) Appl. No.: 13/440,033

(22) Filed: Apr. 5, 2012

(65) Prior Publication Data

US 2012/0240758 A1 Sep. 27, 2012

Related U.S. Application Data

(63) Continuation-in-part of application No. 13/094,851, filed on Apr. 27, 2011, now Pat. No. 8,402,876, which is a continuation-in-part of application No. 12/903,258, filed on Oct. 13, 2010, now abandoned.

(60) Provisional application No. 61/255,109, filed on Oct. 27, 2009.

(51) Int. Cl.
*F41H 5/04* (2006.01)

(52) U.S. Cl.
CPC ..... *F41H 5/0414* (2013.01); *F41H 5/0492* (2013.01)

(58) Field of Classification Search
CPC ... F41H 5/0492; F41H 5/0414; F41H 5/0428; F41H 5/0464; F41H 5/0421; F41H 5/0435
USPC ..... 89/36.02, 36.07, 903–909, 917, 36.04, 89/36.05; 109/49.5; 428/49; 501/127
See application file for complete search history.

(56) References Cited

U.S. PATENT DOCUMENTS

| | | | | | |
|---|---|---|---|---|---|
| 1,894,605 | A * | 1/1933 | Wright | A63H 33/04 | 446/122 |
| 4,061,815 | A | 12/1977 | Poole, Jr. | | |
| 4,483,020 | A | 11/1984 | Dunn | | |
| 4,529,640 | A | 7/1985 | Brown et al. | | |
| 4,836,084 | A | 6/1989 | Vogelesang et al. | | |
| 4,868,040 | A | 9/1989 | Hallal et al. | | |
| 5,705,764 | A | 1/1998 | Schade et al. | | |
| 5,763,813 | A | 6/1998 | Cohen et al. | | |
| 5,804,757 | A * | 9/1998 | Wynne | F41H 5/0428 | 2/2.5 |
| 5,972,819 | A * | 10/1999 | Cohen | F41H 5/023 | 428/911 |
| 6,112,635 | A | 9/2000 | Cohen | | |
| 6,203,908 | B1 | 3/2001 | Cohen | | |

(Continued)

FOREIGN PATENT DOCUMENTS

| | | | |
|---|---|---|---|
| AT | WO 0241719 A1 * | 5/2002 | A41D 31/0061 |
| EP | 1190647 | 3/2002 | |

(Continued)

OTHER PUBLICATIONS

Official Action Dated Nov. 19, 2012 From the US Patent and Trademark Office Re. U.S. Appl. No. 12/903,258.

(Continued)

*Primary Examiner* — Troy Chambers
*Assistant Examiner* — John D Cooper

(57) ABSTRACT

An armor system pellet and an array and armor composed therefrom are provided. The pellet includes a pellet body and a plurality of projections for interlocking adjacent pellets when arranged in an array. The projections are configured for maximizing a contact area between adjacent pellets without substantially restricting independent movement of each of the pellets.

19 Claims, 12 Drawing Sheets

(56) References Cited

U.S. PATENT DOCUMENTS

| | | | | |
|---|---|---|---|---|
| 6,289,781 | B1 | 9/2001 | Cohen | |
| 6,408,734 | B1 | 6/2002 | Cohen | |
| 6,500,507 | B1 * | 12/2002 | Fisher | F41H 5/0428 2/2.5 |
| 6,575,075 | B2 | 6/2003 | Cohen | |
| 6,807,891 | B2 * | 10/2004 | Fisher | F41H 5/0428 2/2.5 |
| 7,807,247 | B1 | 10/2010 | Bromley et al. | |
| 8,291,808 | B2 | 10/2012 | Howland | |
| 2005/0015837 | A1 | 1/2005 | Saito | |
| 2006/0243127 | A1 * | 11/2006 | Cohen | F41H 5/0492 89/36.02 |
| 2007/0017359 | A1 * | 1/2007 | Gamache | F41H 5/0492 89/36.04 |
| 2007/0089597 | A1 | 4/2007 | Ma | |
| 2007/0137471 | A1 * | 6/2007 | Mazur | F41H 5/013 89/36.02 |
| 2009/0078109 | A1 * | 3/2009 | Baxter | F41H 5/0492 89/36.02 |
| 2010/0101402 | A1 * | 4/2010 | Ma | F41H 5/0492 89/36.02 |
| 2011/0239849 | A1 * | 10/2011 | Neal | B32B 3/06 89/36.02 |
| 2012/0090453 | A1 | 4/2012 | Cohen | |
| 2012/0137864 | A1 * | 6/2012 | Ortiz | F41H 5/0492 89/36.01 |
| 2012/0186434 | A1 | 7/2012 | Cohen | |
| 2015/0219424 | A1 | 8/2015 | Cohen et al. | |

FOREIGN PATENT DOCUMENTS

| | | | | |
|---|---|---|---|---|
| EP | 1190647 | A2 * | 3/2002 | A47C 7/26 |
| EP | 2284474 | | 2/2011 | |
| GB | 1081464 | | 8/1967 | |
| GB | 1352418 | | 5/1974 | |
| GB | 2272272 | | 5/1994 | |
| WO | WO 93/21492 | | 10/1993 | |
| WO | WO 94/24894 | | 11/1994 | |
| WO | WO 98/15796 | | 4/1998 | |
| WO | WO 02/41719 | | 5/2002 | |
| WO | WO 0241719 | A1 * | 5/2002 | A41D 31/0061 |
| WO | WO 2009/095903 | | 8/2009 | |
| WO | WO 2012/146995 | | 11/2012 | |
| WO | WO 2014/045248 | | 3/2014 | |

OTHER PUBLICATIONS

Notice of Allowance Dated Nov. 7, 2012 From the US Patent and Trademark Office Re. U.S. Appl. No. 13/094,851.

International Search Report and the Written Opinion Dated Sep. 18, 2012 From the International Searching Authority Re.: Application No. PCT/IB2012/051697.

International Preliminary Report on Patentability Dated Nov. 7, 2013 From the International Bureau of WIPO Re. Application No. PCT/IB2012/051697.

International Search Report and the Written Opinion Dated Jan. 16, 2014 From the International Searching Authority Re. Application No. PCT/IB2013/058756.

Supplementary European Search Report and the European Search Opinion Dated Aug. 29, 2014 From the European Patent Office Re. Application No. 12776430.6.

International Preliminary Report on Patentability Dated Apr. 2, 2015 From the International Bureau of WIPO Re. Application No. PCT/IB2013/058756.

* cited by examiner

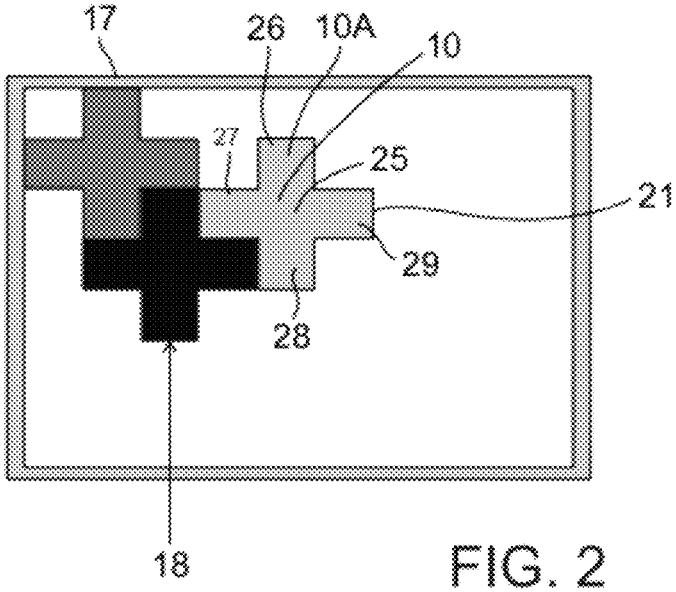
FIG. 2
FIG. 3A
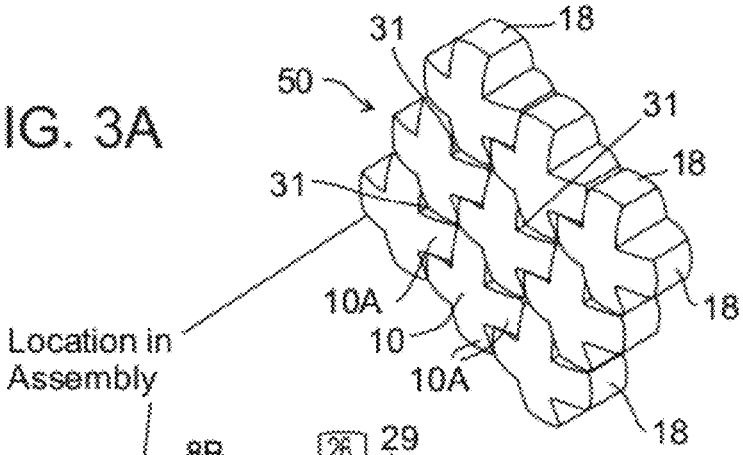
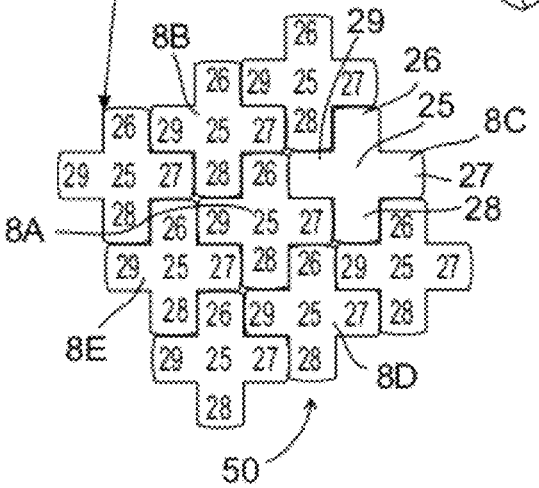
FIG. 3B

ARMOR SYSTEM

RELATED APPLICATIONS

This application is a Continuation-in-Part (CIP) of U.S. patent application Ser. No. 13/094,851 filed Apr. 27, 2011, which is a Continuation-in-Part (CIP) of U.S. patent application Ser. No. 12/903,258 filed Oct. 13, 2010, which claims the benefit of priority of U.S. Provisional Patent Application No. 61/255,109 filed Oct. 27, 2009.

The contents of the above applications are all incorporated herein by reference.

FIELD AND BACKGROUND OF THE INVENTION

The present invention relates to an armor system and, more particularly, to a ballistic armor system that includes an array of interlocked pellets.

A variety of materials can be used in an armor system designed to protect vehicles or individuals from projectile and shrapnel threats. Although present day armor systems can provide greater protection, there is oftentimes a tradeoff between protection and mobility due to the weight, bulk of armor systems and cost. Furthermore, munitions are continually being invented to eliminate the effectiveness of the armor.

The weight and bulk of an armor system tends to be more critical in personal armor (e.g. helmets and body armor). In such cases, advances have led to use of composite materials in order to increase mobility and decrease weight while increasing the degree of protection. For example, military helmets have evolved from the steel helmets of World Wars I and II, to plastic helmets, to the current state-of-the-art composite helmets which include aramid fibers capable of stopping handgun rounds but incapable of stopping larger projectiles.

Modern body armor (e.g. the bulletproof or ballistic vest) has also evolved from the cotton and nylon vests of the early 20th century to the fiber reinforced plastics of 1950-70s to the Kevlar and ceramic/metal plate armor of present day.

Ceramic materials have long been considered for use in the fabrication of armor components due to their hardness and relative lightweight. However, the use of ceramic materials in armor has been limited by a cost, weight and lack of repeat hit capability due to the brittleness of the material. Armor-grade ceramics can be extremely hard, brittle materials, and thus following impact of sufficient energy, a monolithic ceramic plate will fracture extensively, leaving many smaller pieces and a reduced ability to protect against subsequent hits. Thus, multiple hits can be a serious problem with ceramic-based armors.

In order to traverse these limitations of ceramics, state-of-the-art integral armor designs typically utilize arrays of ballistic grade ceramic tiles within an encasement of polymer composite plating. Such an armor system will erode and shatter projectiles, including armor-piercing projectiles, thus creating effective protection at a somewhat reduced weight.

Ceramic, metal (e.g., steel or titanium), or polyethylene plate armor systems have recently seen military use, and have demonstrated varying degrees of protection against projectile threats. Although effective, these body armor systems have been criticized for imposing weight and mobility constraints on the user while being expensive to mass-produce.

Thus, there is a continuing and ongoing need to provide improved ballistic protection with a minimal mobility and weight penalty.

SUMMARY OF THE INVENTION

According to one aspect of the present invention there is provided an armor system pellet comprising a pellet body and a plurality of projections for interlocking adjacent pellets when arranged in an array, the projections being configured for maximizing a contact area between adjacent pellets without substantially restricting independent movement of each of the pellets.

According to further features in preferred embodiments of the invention described below, each of the plurality of projections of the pellet is capable of contacting at least two projections of adjacent pellets when arranged in an array.

According to still further features in the described preferred embodiments the maximizing a contact area between adjacent pellets maximizes a transfer of ballistic impact force from the pellet to the adjacent pellets.

According to still further features in the described preferred embodiments the pellet comprises any number (e.g. 4) of finger-like projections extending radially outwardly from the pellet body.

According to still further features in the described preferred embodiments each of the four finger-like projections is capable of contacting three finger-like projections of adjacent pellets when arranged in an array.

According to still further features in the described preferred embodiments the pellet is composed of a ceramic material.

According to still further features in the described preferred embodiments the ceramic material includes a material selected from the group consisting of alumina, boron carbide, boron nitride, silicon carbide, silicon nitride, and zirconium oxide.

According to still further features in the described preferred embodiments a front surface of the pellet is convex.

According to still further features in the described preferred embodiments a front surface of the plurality of projections is convex.

According to still further features in the described preferred embodiments a largest diameter of the pellet exceeds a largest height thereof.

According to another aspect of the present invention there is provided an armor system comprising an array composed of one or more pellet types.

According to still further features in the described preferred embodiments the array includes at least two types of pellets differentiated by a number of the plurality of projections.

According to still further features in the described preferred embodiments the armor system further comprises front and back plates sandwiching the array.

According to still further features in the described preferred embodiments the armor system further comprises a polymer resin disposed within the array and/or between the array and the front and/or back plates.

According to still further features in the described preferred embodiments the armor system further comprises a flexible support structure for securing the array to the front and/or back plates.

According to still further features in the described preferred embodiments the armor system further comprises connectors for interconnecting the front and back plates through the support structure.

According to still further features in the described preferred embodiments the armor system further comprises a shock absorbing layer disposed between the front and back plates.

According to still further features in the described preferred embodiments the armor system further comprises at least two layers of the array.

According to still further features in the described preferred embodiments the armor system further comprises a high tensile strength fabric disposed around the array.

According to still further features in the described preferred embodiments the fabric includes carbon fibers, fiberglass fibers, aramid fibers and/or metallic fibers.

According to still further features in the described preferred embodiments the armor system is configured as body armor.

According to still further features in the described preferred embodiments the armor system is configured as vehicle armor.

According to yet another aspect of the present invention there is provided an armor system comprising a plurality of pellets of at least two types each type having a unique number of projections, the plurality of pellets being capable of interlocking when arranged in an array with the projections configured for maximizing a contact area between adjacent pellets without substantially restricting independent movement of each of the plurality of pellets.

According to still further features in the described preferred embodiments the projections of at least one type of pellet are beveled such that a locking pattern of a front face of two adjacent pellets of the array is different than the locking pattern of a back face of the two adjacent pellets of the array.

According to an additional aspect of the present invention there is provided a method of protecting an individual or an object such as a vehicle from projectiles or shrapnel, comprising using the armor system described herein to cover at least a portion of the individual or object thereby providing protection from the projectile or shrapnel.

The present invention successfully addresses the shortcomings of the presently known configurations by providing an armor system that provides superior protection against projectiles and shrapnel while being lighter weight, modular, configurable for use on a variety of surfaces, easily repairable and potentially relatively inexpensive to produce.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1D illustrates perpendicular center hit (P arrow) and resultant movement of pellet (in-out and yaw). FIG. 1E illustrates angled center hit (P arrow) and resultant movement of pellet (side to side, in-out and yaw). FIG. 1F illustrates perpendicular hit to projection (P arrow) and resultant movement of pellet (pitch and yaw); FIG. 1G illustrates angled hit to projection (P arrow) and resultant movement of pellet (roll, side to side and yaw).

FIG. 2 is a partial array of three cross-shaped pellets having straight sides.

FIGS. 3A-B illustrate isometric (FIG. 3A) and top (FIG. 3B) views of an array of arcuate cross-shaped pellets constructed in accordance with the teachings of the present invention.

FIGS. 8A-B illustrate two faces of a five pellet array, FIGS. 8C and 8E illustrate the two faces of a single pellet, while FIGS. 8D and 8F illustrate the two faces of a multi-pellet array.

DESCRIPTION OF THE PREFERRED EMBODIMENTS

Figure 1A:
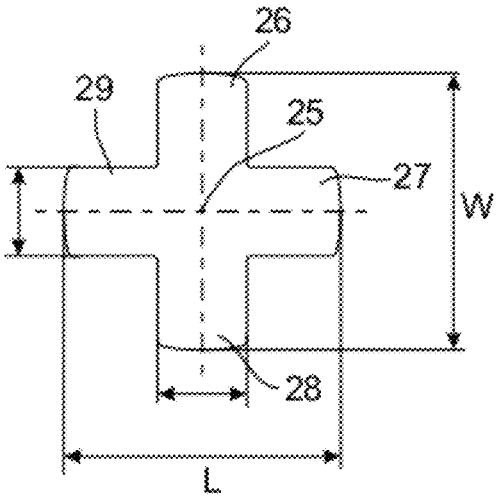
FIGS. 1A-C illustrate a cross-shaped embodiment of the armor system pellet of the present invention in top (FIG. 1A), isometric (FIG. 1B) and side (FIG. 1C) views.

The present invention is of an armor system which can be used to provide vehicles or individuals with a high degree of protection from projectiles or shrapnel while imposing reduced constraints on mobility.

The principles and operation of the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Protective armor for heavy and mobile military equipment, such as tanks utilizes layers of materials (no longer steel). Although such armor is heavy it provides good protection against explosives and projectiles at a relatively small mobility penalty to heavy vehicles. However, in relatively lighter vehicles (cars, jeeps), airplanes and boats as well as personnel, such armor material adds significant weight and bulk (each millimeter of a steel panel adds a weight factor of 7.8 kg/m$^2$) adding significant stress on the vehicle which severely compromises mobility.

Due to these limitations, state of the art armor systems used in protection of light vehicles and personnel provide less than desired protection.

In order to provide effective protection while minimizing negative affects on mobility, the configuration of the armor plates used in the armor system must maximize protection and mobility while minimizing weight.

While reducing the present invention to practice, the present inventor has devised a ballistic armor system which utilizes an array of interlocked pellets configured for:

(i) enabling each pellet of the array to move independently (6 degrees of freedom or less, depending on the configuration of the pellet) thus increasing the 'plasticity' of the array and its use in both vehicle and personal protection; and (ii) dissipating a kinetic force of an incoming projectile across the array thereby preventing projectile penetration and minimizing projectile damage to the impacted pellet.

Such features are enabled by the specific design of the present pellet which is configured such that when arranged in an array, each pellet engages neighboring pellets through projections designed to increase a contact area between pellets (see FIGS. 1*a-c* and 3*a-b* for an exemplary pellet and array). Such engagement between pellets is referred to herein as pellet "interlocking".

Interlocking is designed to allow independent movement of each pellet (in-out, side-to-side, up-down, pitch, roll and/or yaw—FIG. 1*d*) while maximizing an energy dissipation capabilities of an array formed from such pellets. The distance moved by each pellet can be several mm to several cm depending on the type of movement, the configuration of the pellet, its size and the type of armor incorporating the array. This increases wearability of an armor system (when configured as a vest) as well as its adaptability (plasticity) to varying geometric surfaces of vehicles while providing dissipation capabilities superior to those of monolithic plates.

Dissipation of the kinetic forces of an on-coming projectile is achieved via two mechanisms:

(i) Independent movement of the pellet impacted by the projectile; the pellet will move in (normal force) with movement of projectile and spin (yaw) with the spin of the projectile, such independent movement will dissipate some of the kinetic energy. In cases of body armor which also includes additional layers of materials (ballistic fabrics etc) such movement could be used to transfer energy to such layers.

Figure 7A:
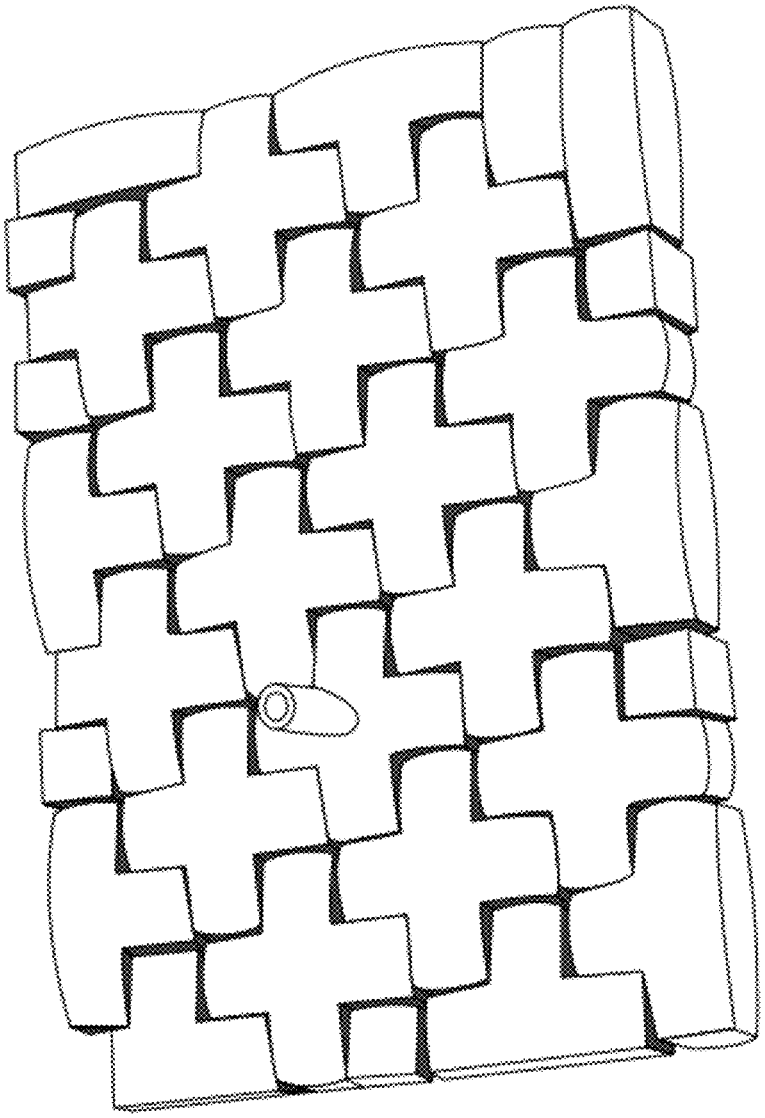
FIGS. 7A-B illustrate impact of a projectile on an array of pellets (FIG. 7A) and a resultant ripple effect (FIG. 7B).
Figure 7B:
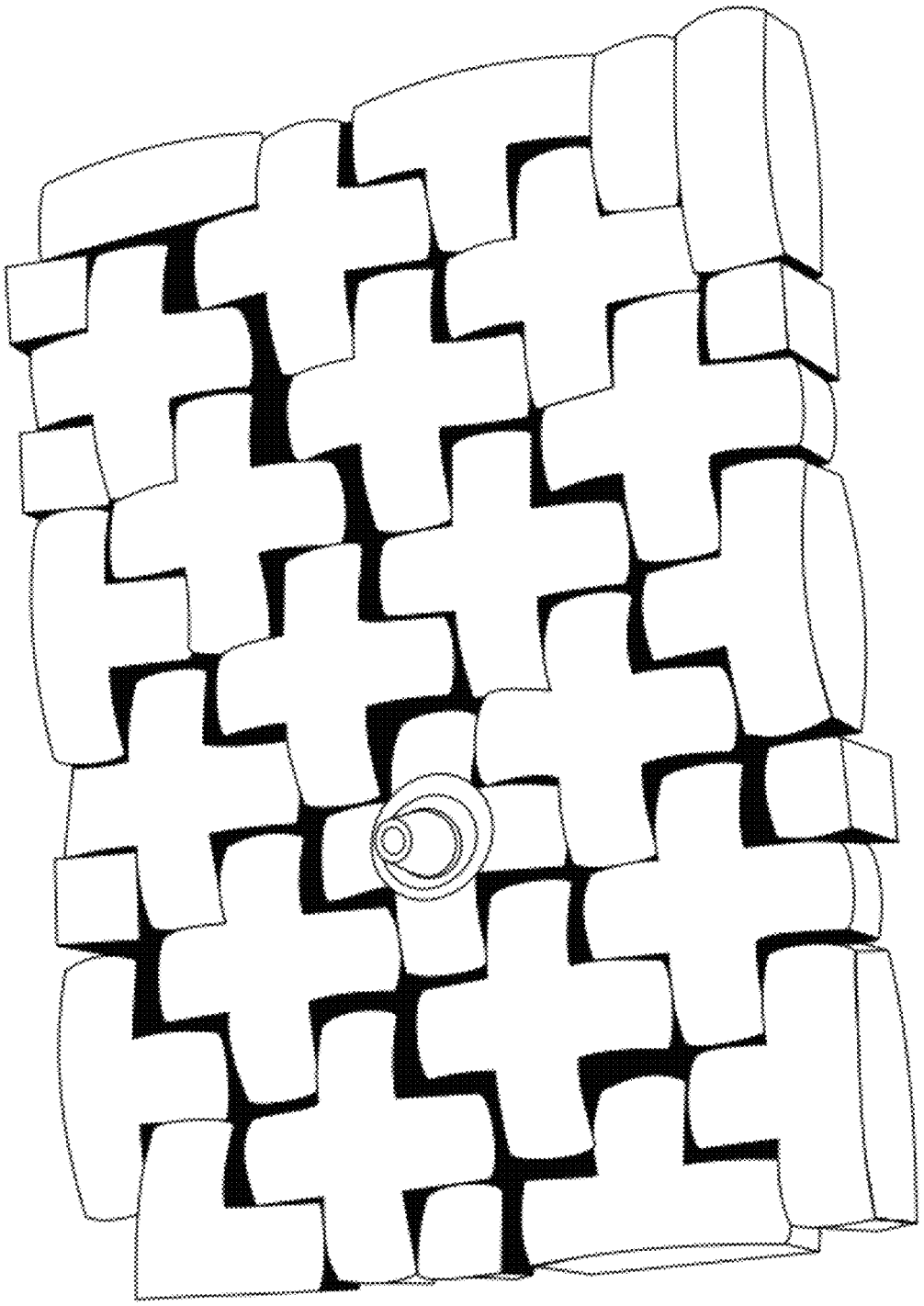

(ii) 'Collective' movement of the array; due to the large contact area between pellets, projectile impact will be 'conducted' from the impacted pellet to neighboring pellets, thereby dissipating the kinetic force across the array ('ripple effect'). Such a ripple effect is illustrated in FIGS. 7*a-b*.

Thus, according to one aspect of the present invention there is provided an armor system constructed from a plurality of pellets. As used herein, the term "pellet" refers to "a small, solid or densely packed mass of material of any shape. The pellet of the present invention includes a pellet body and a plurality of projections extending therefrom preferably in a radially outward direction. The combination of the pellet body and projections can form any shape suitable for creating an array of closely packed pellets (of one or more unique shapes). Preferred shapes include a cross or plus sign (e.g. FIGS. 5-6), a star, a T-shape, a zigzag shape (FIG. 4*b*) or an asymmetric pellet having two different faces (FIGS. 8*a-f*).

Arrays formed from such shapes can include one or several pellet shapes. For example, an array can be formed from a cross-shaped pellet as is illustrated in FIGS. 3*a-b*, from a combination of cross-shaped pellets and a T-shaped pellet (used on edges, FIGS. 5-6) or from the combination of cross and zigzag pellets shown in FIG. 4*b*.

The projections (also referred to herein as "fingers") are configured for enabling adjacent pellets to interlock when arranged in an array. As is further described herein, such interlocking does not lock adjacent pellets (against movement) but rather increases a contact area therebetween (edge surface contact) to enable dissipation of kinetic forces. Thus, the projections of the pellet increase an engagement between adjacent pellets but allow each pellet to move independently.

Contact between projections of adjacent pellets can be through one or more projections, preferably, each projection of the pellet is capable of contacting at least two projections of adjacent pellets when arranged in an array.

For example, in an array configured from cross-shaped pellets (FIGS. 3*a-b*), each cross-pellet is surrounded by four adjacent cross-shaped pellets (each contributing 2 projections), and each projection of the center pellet contacts 3 other projections (of two adjacent pellets).

An incoming projectile may contact the pellet array in one of three ways:

(i) Center contact—the impact is absorbed by the pellet and dissipated by independent movement thereof as well as conduction of kinetic energy to neighboring pellets (ripple effect) . Since the entire pellet participates in stopping the projectile penetration is not possible without pulverization of the pellet, an energy-intensive task.

(ii) Off center contact—the impact causes projectile tilt (yaw or pitch), thereby dissipating some of the kinetic energy through pellet movement and some through increased projectile contact and friction since a larger frontal area is contacted by the projectile. Such tilting deflects the projectile sideways and allows further dissipation of kinetic energy by other pellets of the array (ripple effect)

(iii) Gap (valley) contact—the projectile jams in the gap between projections. Some of the kinetic force of the impact is translated into a sideward force which is dissipated through the array (ripple effect).

The pellet of the present invention can be fabricated from any material including steel, aluminum, magnesium, titanium, nickel, chromium, iron and/or their alloys as well as glass, graphite and polymers such as silicon-based polymers, elastomeric carbon-based polymers, Dyneema™ Spectra Shield™, a thermoplastic polymer such as polycarbonate, or a thermoset plastic such as epoxy or polyurethane. The pellet is preferably fabricated from a ceramic which includes alumina, boron carbide, boron nitride, silicon carbide, silicon nitride, zirconium oxide, sintered oxide, nitrides, carbides and borides of alumina, magnesium, zirconium, tungsten, molybdenum, titanium, silica, titanium diboride, silicon oxide, magnesium oxide, silicon aluminum oxynitride.

Tables 1-3 below exemplify typical dimensions of a cross-shaped pellet embodiment of the present invention.

TABLE 1

| | Cross-shaped Pellet Depth/Weight-WIDTH 26 mm | | | |
|---|---|---|---|---|
| SPECTRA ™ Backing | | 8 mm/3.96 psf | 10 mm/4.95 psf | 12 mm/6.6 psf |
| | 8 mm/0.4 psf | 16 mm/4.36 psf | 18 mm/5.35 psf | 20 mm/7.0 psf |
| | 10 mm/0.5 psf | 18 mm/4.46 psf | 20 mm/5.45 psf | 22 mm/7.1 psf |
| | 12 mm/0.6 psf | 20 mm/4.56 psf | 22 mm/5.55 psf | 24 mm/7.2 psf |

TABLE 2

| | Cross Pellet Depth/Weight-WIDTH 22 mm | | | |
|---|---|---|---|---|
| SPECTRA ™ Backing | | 8 mm/3.96 psf | 10 mm/4.95 psf | 12 mm/6.6 psf |
| | 8 mm/0.4 psf | 16 mm/4.36 psf | 18 mm/5.35 psf | 20 mm/7.0 psf |
| | 10 mm/0.5 psf | 18 mm/4.46 psf | 20 mm/5.45 psf | 22 mm/7.1 psf |
| | 12 mm/0.6 psf | 20 mm/4.56 psf | 22 mm/5.55 psf | 24 mm/7.2 psf |

TABLE 3

| | Cross Pellet Depth/Weight WIDTH 12 mm | | | |
|---|---|---|---|---|
| SPECTRA ™ Backing | | 8 mm/3.96 psf | 10 mm/4.95 psf | 12 mm/6.6 psf |
| | 8 mm/0.4 psf | 16 mm/4.36 psf | 18 mm/5.35 psf | 20 mm/7.0 psf |
| | 10 mm/0.5 psf | 18 mm/4.46 psf | 20 mm/5.45 psf | 22 mm/7.1 psf |
| | 12 mm/0.6 psf | 20 mm/4.56 psf | 22 mm/5.55 psf | 24 mm/7.2 psf |

psf—pounds per square foot

In order to further increase the ability of the pellet and array to withstand projectile impact, a front surface (face) of the pellet can be shaped in order to deflect an oncoming projectile. For example, a front surface of the pellet can be convex (see FIG. 1*b* for an example) such that a height of the pellet is greatest at the center of the pellet body and tapers down outwardly along the projections. Such surface shaping can further deflect an oncoming projectile and dissipate some of its kinetic energy.

A fundamental feature of the present invention—regardless of whether according to "first-mode," "second-mode," or "hybrid-mode" inventive practice—is the non-parallelism of the front and back surfaces, or portions thereof, of the inventive ceramic element. Inventively prescribed textures and/or shapes impart front-and-back non-parallelism to the present invention's ceramic elements. When an inventive ceramic element is impacted by a projectile, the non-parallel character of the front and back faces, relative to each other, tends to reduce both the spatial coincidence and the temporal coincidence, and hence the deleterious effects, of the interactions between the incident shock waves and the reflected shock waves.

The armor system of the present invention can include the pellet array described herein for deforming and shattering an impacting high velocity projectile and an inner layer adjacent to the pellet array which includes a ballistic material (e.g. Dyneema, Kevlar, aluminum, steel, titanium, or S2) for absorbing remaining kinetic energy from projectile fragments.

Although the pellets of an array can be packed to maximize contact between projections (no gap between projections), in some embodiments, the array can be packed such that a small gap (also referred to herein as valley) remains between projections (e.g. 0.1-4 mm or more depending on the NIJ level of protection desired). Such a packing configuration can reduce weight and improve dissipation and attenuation of shock waves resulting from projectile impact. The resin can dissipate kinetic forces by absorbing forces transmitted thereto by movement of the pellets.

In cases where the array is not tightly packed, a polymer resin can be disposed within the gaps between projections and between the array and the front and/or back plates. Such a polymer resin can be resin such as Tuff Stuff™ which includes two components, Isocyanate and Resin. When casting the panel with the solidified material, the casting materials (e.g. resin, molten alumina, epoxy, and the like) seeps into all spaces between the pellets.

Thermoset resins can also be used by the present invention. Such resigns are usually liquid or malleable prior to curing, and are designed to be molded into their final form, or used as adhesives. Examples of Thermosets resins include Vulcanized rubber, Bakelite, a Phenol Formaldehyde Resin (used in electrical insulators and plastic wear), Urea-formaldehyde foam (used in plywood, particleboard and medium-density fiberboard), melamine resin (used on worktop surfaces), polyester resin [used in glass-reinforced plastics/fiberglass (GRP)], epoxy resin (used as an adhesive and in fibre reinforced plastics such as glass reinforced plastic and graphite-reinforced plastic) and polyimides used in printed circuit boards and in body parts of modern airplanes.

Since optimal functionality of the armor system of the present invention requires that pellets have some independent movement, an array of pellets used in such armor system are preferably not secured directly to the plates but rather are secured to a flexible support that is connected to the plates. Such a flexible support can be composed from an elastic mesh (e.g., viscoelastic), a matrix material and/or a bonding material.

A pellet array constructed in accordance with the teachings of the present invention can include any number of pellets of any size depending on the intended use of the array and the surface coverage desired.

For example an array of cross-shaped pellets configured for use in protecting a light vehicle (e.g. Jeep, car), an airplane or a boat can include 56,000 pellets each having a width of 26 mm, a height of 16 mm and a length of 26 mm. Such an array can be disposed between a front and back plates constructed from an alloy or woven material. Preferably such a multi-layered armor panel includes an inner layer of a tough woven textile material (e.g. Dyneema™ Spectra Shield™, Kevlar™ a thermoplastic polymer such as polycarbonate, or a thermoset plastic such as epoxy or polyurethane for enabling asymmetric deformation of projectile fragments and for absorbing remaining kinetic energy from such fragments. Such a multi-layer panel would be capable of stopping three projectiles fired sequentially at a triangular area of the panel (the height of such a triangle is substantially equal to three times the length of the axis of a pellet).

In cases where the array is not tightly packed, an elastic polymer resin can be disposed within the gaps between projections and between the array and the front and/or back plates. The resin can completely or partially cover the front and back faces of the array, or be disposed therebetween only. Use of such a resin can help further dissipate kinetic forces by absorbing some of the movement of the pellets.

An array of cross-shaped pellets configured for use in protecting an individual can include 144 pellets each having a length of 12 mm, a width of 12 mm and a height of 10 mm. Such an array can be disposed between a front and back plates constructed from tough woven textile material, preferably aramid synthetic fibers and polyethylene fibers. Suitable synthetic fibers are commercially available under trade names such as Dyneema™, spectra Shield™ and Kevlar™.

The following describes several specific examples of a pellet (which is referred to herein as pellet 8), an array formed therefrom (which is referred to herein as array 50) and an armor system including array 50 (which is referred to herein as system 20).

Figure 1B:
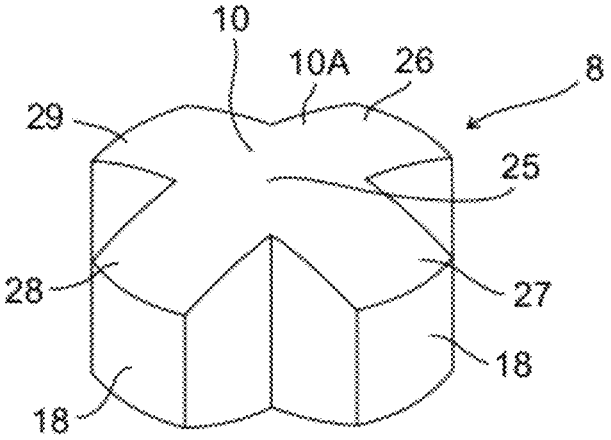
Figure 1C:
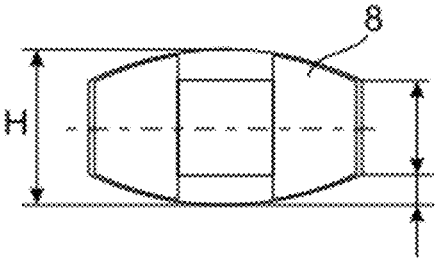
Figure 1D:
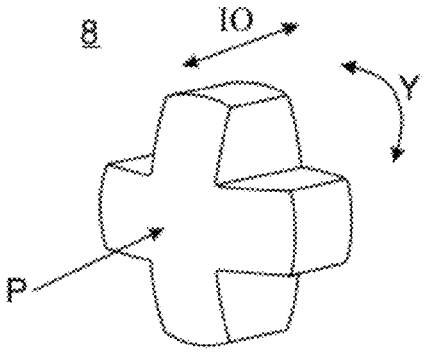
FIGS. 1D-G illustrate independent movement of a pellet in an array following different types of projectile (P) hits.
Figure 1E:
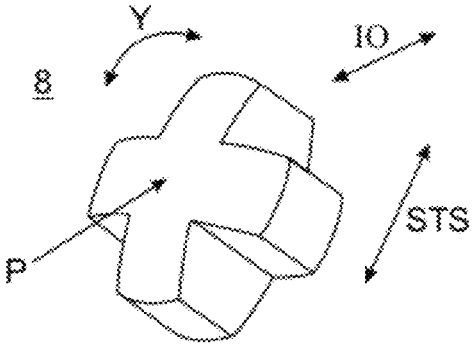
Figure 1F:
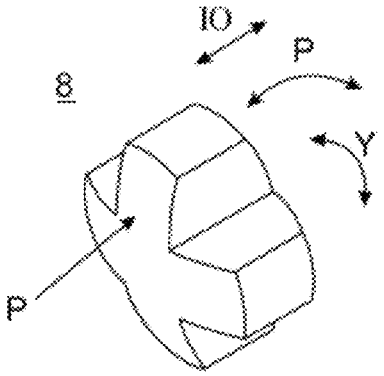
Figure 1G:
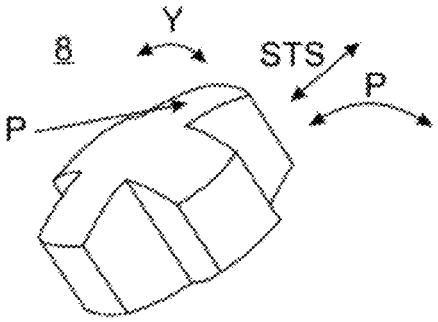

FIGS. 1*a-c* illustrate pellet 8 which can be used to construct an armor system according to the teachings of the present invention.

Pellet 8 of FIGS. 1*a-c* is cross shaped, however, it should be noted that any shape suitable for forming an array of interlocking pellets can be used by the present invention.

Pellet 8 includes a pellet body (also referred to herein as center) 25 and four projections (also referred to herein as fingers) 26, 27, 28, 29 projecting perpendicularly from center 25.

Pellet body 25 can be solid (as shown in FIGS. 1*a-c*) or it can include an opening 23 (FIG. 4*a*) which can accept an insert of any shape and size preferably fabricated from a ballistic material (e.g. ceramic). Opening 23 can be cylindrical (e.g. 10 mm in diameter) with a length sized to traverses the entire height of pellet body 25. A cylindrical insert sized for such an opening 23 can be mounted within pellet body 25 and optionally glued therein. A modular pellet formed from such a pellet body and insert can better handle the kinetic forces associated with the spin of the projectile in the case of a center shot.

The insert can be mounted within opening 23 in pellet body 25 such that its faces are flush with the pellet faces, or are raised with respect thereto. The faces of the insert can be flat concave or convex. Pellet body 25 can alternatively include a partial opening (preferably in the back face) for reducing the pellet weight and enabling the pellet to break in a predetermined manner when impacted by a projectile.

Pellets 8 can be arranged in any configuration to form an array 50 (FIGS. 3*a-b*). As is shown in FIG. 3*b*, each pellet 8 (at least in the non-peripheral portion of the array 50), can be supported by fingers of adjacent pellets 8.

According to one preferred embodiment of the present invention and as is shown in FIG. 3*b*, two fingers from each of the four adjacent pellets 8 support each pellet 8 surrounded by these adjacent pellets 8. For example, as is shown in FIG. 3*b*, pellet 8A (center of FIG. 3*b*) is surrounded by pellets 8B, 8C, 8D, 8E, each of which support pellet 8A via two projections (fingers).

Specifically, cross-pellet 8B contributes fingers 27, 28; cross-pellet 8C contributes fingers 28, 29; cross-pellet 8D contributes fingers 26, 29 and cross-pellet 8E contributes fingers 26, 27. Although FIG. 3*b* only shows an array 50 including nine cross-pellets, in an actual armor, array 50 may have dozens to several hundred pellets 8.

A front surface of pellets 8 can be flat, as is shown in FIG. 2, or convex as is shown in FIG. 3*a*.

An array 50 assembled from flat pellets 8 has a flat front face, while an array 50 formed from convex pellets includes triangular-shaped voids in the front face which are referred to herein as valleys 31 (FIG. 3*a*). Such valleys can have a volume that is less than 25%, 15%, 10%, 5% or 1% of the total volume of pellet 8 and typical dimensions of 0.5-5 mm in length, 0.5-5 mm in width and 5-9 mm in height in a pellet 8 having the dimensions mentioned hereinabove.

Figure 5:
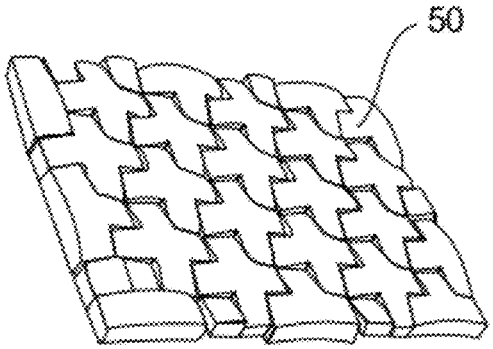
FIG. 5 is an array of cross-shaped pellets with T-shaped pellets edges.

Although flat pellets 8 can be used in an array 50, use of convex pellets in an array 50 is presently preferred since it reduces the overall weight of array 50 and provides an array which better able to deflect a projectile due to the fact that convex face 10 is oriented in the direction of impact (FIG. 5). In addition, the present inventors have uncovered that having a valley 31 between 4 adjacent cross-shaped pellets increases array flexibility and attenuates shock wave propagation between front and back plates.

As is shown in FIG. 1*b*, sides 18 of each of fingers 26, 27, 28, 29 of each pellet 8 may be arcuate such that center 25 and fingers 26, 27, 28, 29 define a substantially cylindrical cross-pellet missing four arcuate corner segments.

As is shown in FIGS. 1*b* and 3*a*, an outer face 10 of center 25 (also referred to herein as "top outer face") of each pellet 8 and an outer face 10*a* of each of fingers 26, 27, 28, 29 can be convex. In addition, an opposite bottom face (not shown) may also be convex. Outer face 10 and the bottom face may also be referred to as curved end faces. Outer face 10 may be situated adjacent front plate 30 and the bottom face may be situated adjacent back plate 40 in system 20.

Typical curvature of outer face 10 of center 25 can be 0.1-20 mm (radius of curvature) or more, while the curvature of face 10A of fingers 26, 27, 28, 29 can be 0.01-20 mm or more depending on the size of the pellet.

A length (or diameter) of pellet 8 as measured from one end of finger 27 to an opposite end of finger 29 (FIGS. 1*a*-L) may exceed a height of pellet 8.

As is shown in FIG. 2, pellet 8 may have flat surfaces on outer face 10 of center 25 and outer face 10A of fingers 26, 27, 28, 29 as well as sides 18. Bottom face 14 (not shown in FIG. 2) may also be flat. Accordingly, each of the sides of the fingers may also have flat edges so as to eliminating gaps between pellets 8. Accordingly, center 25 and four finger 26, 27, 28, 29 can define a rectangular cross-pellet that is missing four smaller corner segments. An array 50 in such cases may also be rectangular, as seen in FIG. 2.

Figure 4A:
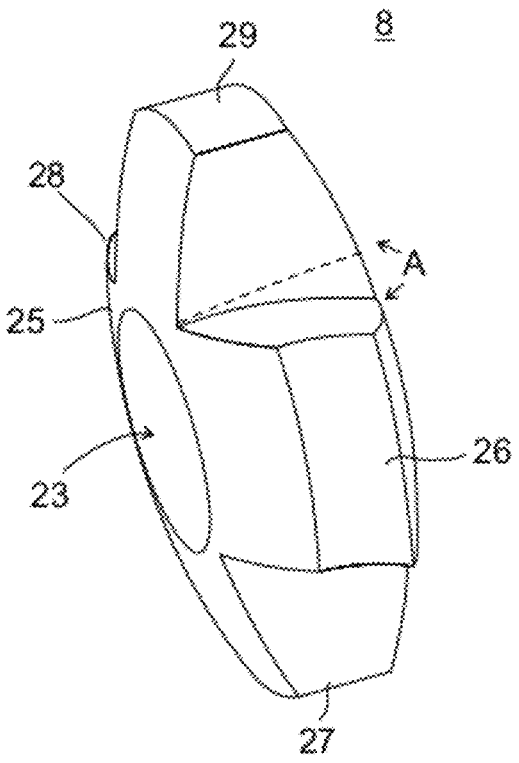
FIG. 4A illustrates a pellet having a central opening and projections designed for use in helmet armor.

FIG. 4*a* illustrates a pellet 8 that includes fingers 26 and 28 which are curved and angled (A) at 10-30 degrees so as to enable use of pellet 8 of FIG. 4*a* in rounded surfaces such as those found in helmets (although other applications also apply). The specific configuration of fingers 26 and 28 (inwardly curving angle A) enable assembly of a non-flat array which can be mounted on/within a helmet without forming voids or spaces between fingers (an inwardly curving finger of one pellet interlocks with an outwardly curving finger of an adjacent pellet which is mounted in a reverse orientation). It will be appreciated that such voids or spaces substantially reduce the ability of an array to stop an incoming projectile and as such, a configuration which enables formation of a curved array without such voids/spaces is clearly advantageous when used in, for example, helmets.

Figure 4B:
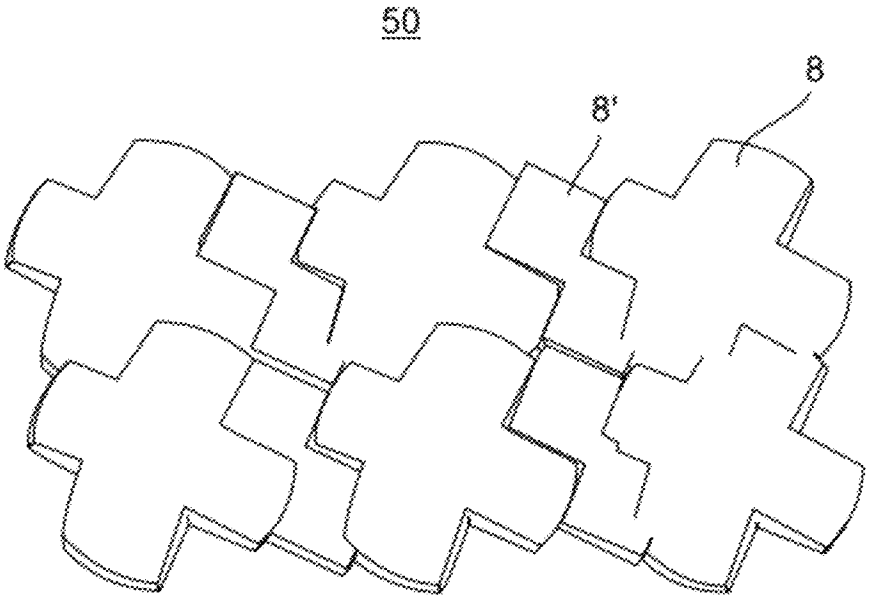
FIG. 4B illustrates an array composed of two types of interlocked pellets, a cross pellet and a zigzag-like pellet.

FIG. 4*b* illustrates an array 50 composed of two types of interlocked pellets. In this configuration of array 50, a cross shaped pellet 8 alternates (and interlocks) with a zigzag-like pellet 8'.

Array 50 can be used in any armor system and in any configuration (e.g. vehicle plates, body vests, helmets etc.)

Figure 6:
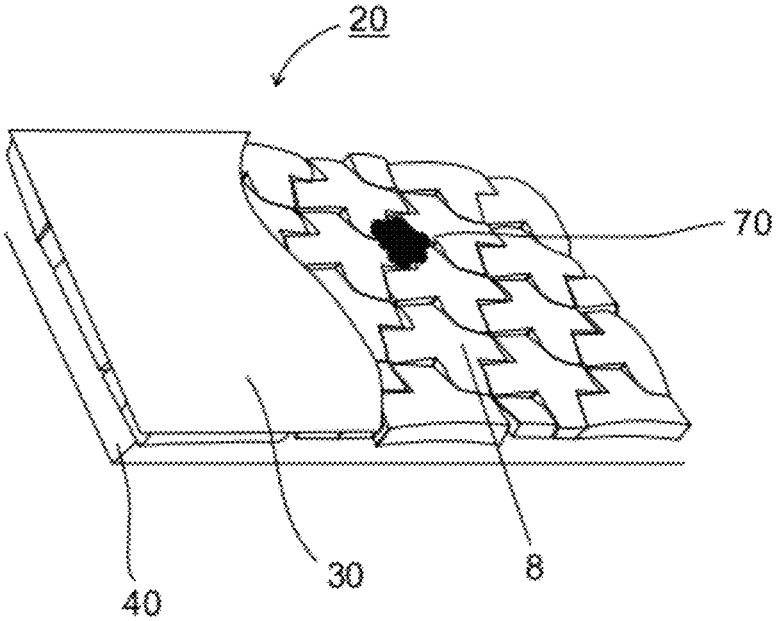
FIG. 6 is a cutaway view of an armor system showing the armor layer composed of the ceramic cross-shaped and T-shaped pellet array.

As is shown in FIG. 6, a system 20 can include a front plate 30 (also referred to herein as top plate), and a back plate 40 (also referred to herein as a backing plate) and an array 50 of pellets 8 disposed between the front and back plates 30, 40. Front plate 30 and back plate 40 can be fabricated from one or more interconnected plates. For example, system 20 can include a plurality of interconnected front plates and a plurality of interconnected back plates which together form a hinged sheet capable of being draped over a vehicle or any other object to be protected. Alternatively, front plate 30 and back plate 40 may be co-extensive, i.e. they can be connected or formed as a unitary structure. In some preferred embodiments, back plate 40 can be formed from a composite of opposing panels filled with a resin or a honeycomb like sandwich.

As is shown in FIG. 6, a polymer resin 70 may be deposited in spaces between the pellets 8 and between array 50 and back plate 40 and/or front plate 30. Polymer resin 70 can be used as a flexible support structure to hold array 50 of pellets 8 to front plate 30 and/or back plate 40. In that sense polymer resin 70 functions as a force dampening matrix with array 50 of pellets 8 being a layer embedded in this matrix.

Back plate 40 can be fabricated from an alloy sheet such as titanium alloy or a hard carbon steel. The primary advantage of metals is that they can more easily be fabricated to the required shape and size. The first outwardly positioned layer 30 is bonded to an intermediate layer 8, which is softer than the first layer 40. The bonding method used depends on the composition of the two materials. Back plate 40 is preferably ultra-light weight and exhibits outstanding out-of-plane stiffness, strength. It is designed to have improved bending stiffness and strength for optimizing the armor performance.

Front plate 30 can be fabricated from an aluminum alloy, a magnesium alloy, low carbon steel, medium carbon steel and aluminum having a Rockwell-C hardness of less than 27. This hardness is equivalent to a Rockwell-A hardness of less than 63.8 and a Rockwell-B hardness of less than 100. The softer metals are more ductile, and thus absorb energy over a greater distance when driven by a projectile.

Front plate 30 can also be composed of a single- or multi-layered fabric network filled with a thermoplastic polymer material.

A fabric web can be used to wrap and hold the array and plates in place and form an integrated armor kit that can be applied to vehicles or used in a vest.

System 20 can also include fasteners (straps hooks etc) which may extend through polymer resin 70 so as to provide further support for holding array 50 of pellets 8 to front plate 30 and/or back plate 40.

System 20 can also include a high tensile strength fabric which can be attached via glue or fasteners to a back surface of array 50. The fabric may comprise at least one of woven carbon fabric, a layer of fiberglass, aramid fabric, carbon fibers, and/or polymeric threads (e.g. polyester threads and/or ultra high resistance polyethylene). Alternatively, a metal sheet may be adhered to the back surface of array 50.

Although FIG. 6 illustrates a system 20 which utilizes a single layer of array 50, it should be noted that system 20 can utilize any number of layers of array 50 depending on use and projectile stopping capabilities desired. Pellets 8 configured for assembling a multi-layer pellet array and a two-layer array formed therefrom are described hereinbelow with reference to FIGS. 9*a-b*.

Fabrication of a system 20 can be effected as follows. An armor panel 20 having spaced apart plates 40 and 30 is assembled and pellets 8 are arranged as a single (or double) layer array. The major axis of the pellets is arranged in substantially parallel orientation with each other and substantially perpendicular to an adjacent surface of plates 40 and 30.

Figure 8A:
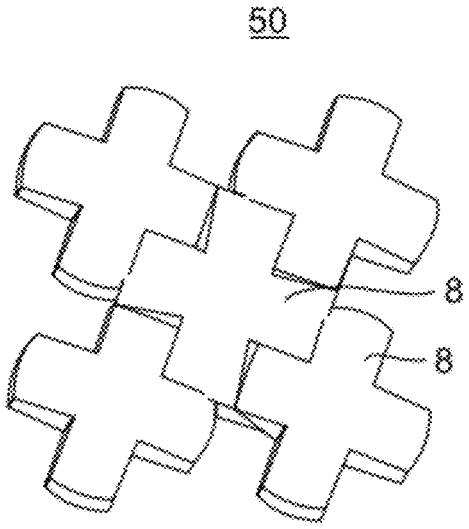
FIGS. 8A-F illustrate another embodiment of the armor pellet of the present invention.
Figure 8B:
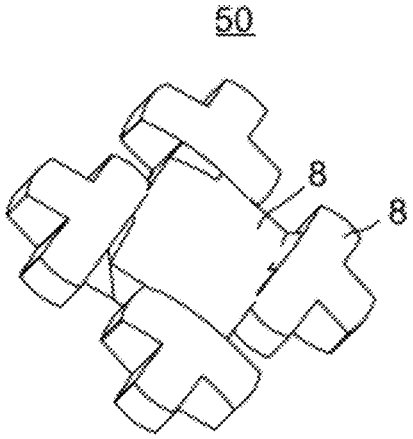
Figure 8C:
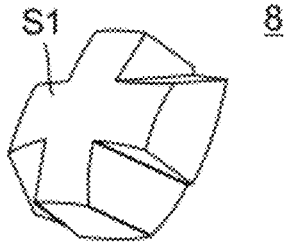
Figure 8D:
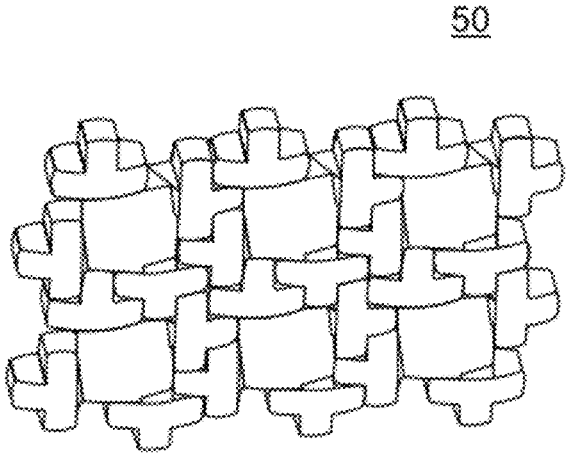
Figure 8E:
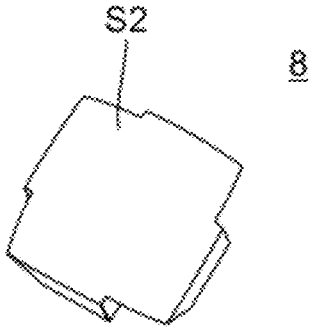
Figure 8F:
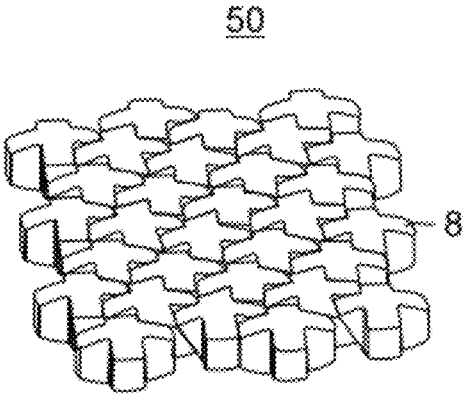

FIGS. 8*a-f* illustrate another embodiment of pellet 8 of the present invention. pellet 8 of this embodiment is asymmetric in that one side (S1) appears cross shaped (FIG. 8*c*) while the opposite side (S2) appears square (FIG. 8*e*).

Such a pellet configuration can reduce pellet/array damage from projectiles designed to maximize damage by deforming to control the depth to which the projectile penetrates.

Figure 9A:
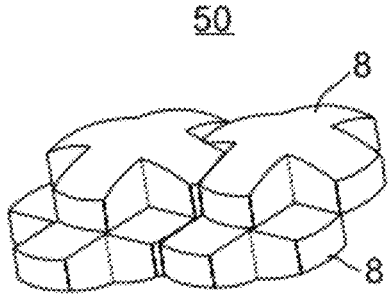
FIGS. 9A-B illustrate a pellet configuration useful in assembling an armor having two array layers, the pellet is shown assembled in a four pellet (FIG. 9A) and multi-pellet (FIG. 9B) array.
Figure 9B:
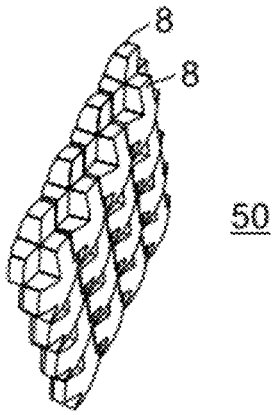

FIGS. 9*a-b* illustrate a pellet configuration which can be used to assemble an array 50 having two pellet layers. pellet 8 of this configuration is similar to that shown in FIGS. 1*a-c* with the exception that one side of pellet 8 is flat and thus enables pellet stacking. Although any stacking pattern can be used, the offset pattern shown in FIGS. 9*a-b* is preferred for some applications since it increases the rigidity of the overall array and better transfers the kinetic energy from one layer to the next.

Thus, the present invention provides an armor system which includes an array of individual interlocked pellets.

The armor system of the present invention provides several advantages:

(i) it is lightweight;

(ii) it is characterized by superior ballistic protection which results from effective dissipation of kinetic forces via movement of individual pellets as well as movement of the entire array;

(iii) it is modular and repairable, individual pellets can be replaced/exchanged;

(iv) independent movement of individual pellets provides flexibility and enables use of the armor on contoured surfaces;

(v) it can resist heat and flame due to the use of ceramics; and (vi) it is easy and relatively inexpensive to manufacture and repair.

It is expected that during the life of this patent many relevant ceramic materials will be developed and the scope of the term ceramic is intended to include all such new technologies a priori.

As used herein the term "about" refers to ±10%.

Additional objects, advantages, and novel features of the present invention will become apparent to one ordinarily skilled in the art upon examination of the following examples, which are not intended to be limiting. Additionally, each of the various embodiments and aspects of the present invention as delineated hereinabove and as claimed in the claims section below finds experimental support in the following examples.

EXAMPLES

Reference is now made to the following examples, which together with the above descriptions, illustrate the invention in a non limiting fashion.

Testing of a Ballistic Armor Comprising Cross-Shaped Pellets

A study was conducted in order to evaluate the ballistics performance of an armor system incorporating the ceramic pellets of the present invention.

Materials and Methods

The armor system tested included several conformal mats each including a spectra shield backing and an array of 144 pellets composed of Si3N4 Silicon Nitride (Length 26 mm Width 26 mm and a Height of 12-20 mm) which was wrapped to prevent delamination. The individual armor mats and systems composed therefrom demonstrated extremely high crush strength. When subjected to a ballistic impact, the projectiles and/or fragments lose most of their kinetic energy on contact with the cross pellets redirecting the resultant forces to the center of the mass and then reflecting it back into the projectile. This prevents penetration of the projectile as well as distributes the energy across a broader area.

A property unique to the present armor system is its ability to be repaired very quickly in the field or operational area. Using simple tools and instructions, personnel can replace the effected pellets in the panel and return it to full ballistic integrity.

The following munitions were used in the study 1. 5.56 mm M995
2. 5.56 M193 Ball
3. 7.62 mm BZ39
4. 7.62 mm M63AP
5. 0.50 cal M2 Ball
6. 0.50 cal M2 AP The munitions were fired at the armor system of the present invention from a distance of 'zero' meters Results Test 1

Test 1 evaluated the present arm or system configured as a Kevlar jacket with ceramic armor against a 7.62 mm projectiles. Table 4 below provides projectile weight in grains, average velocity in feet per second and calculated energy, in foot-pounds, at impact. "PP" designates Partial Penetration with no spalling and is determined successful in stopping the munitions.

TABLE 4

| 7.62 projectile | | | |
|---|---|---|---|
| Projectile Weight (Grains) | Velocity Average (ft/sec) | Energy (Foot Pounds) | Penetration Description |
| 122.3 | 2781 | 2099.81 | cold bore shot |
| 121.2 | 2657 | 1899.49 | cold bore shot |
| 121.0 | 2601 | 1817.27 | PP |
| 121.8 | 2672 | 1930.51 | PP |
| 151.8 | 2607 | 2290.37 | PP |
| 120.8 | 2825 | 2140.21 | PP |
| 120.7 | 2869 | 2205.59 | PP |

Test 2

Test 2 evaluated the present arm or system configured as a Kevlar jacket with ceramic armor against 5.56 mm projectiles. Table 5 below provides projectile weight in grains, average velocity in feet per second, and calculated energy, in foot-pounds, at impact. "PP" designates Partial Penetration with no spalling and is determined successful in stopping the munitions.

TABLE 5

| 5.56 projectile | | | |
|---|---|---|---|
| Projectile Weight (Grains) | Velocity Average (ft/sec) | Energy (Foot Pounds) | Penetration Description |
| 52.1 | 2634 | 802.45 | cold bore shot |
| 52.2 | 2610 | 789.41 | cold bore shot |
| 52.0 | 2596 | 777.97 | PP |
| 52.3 | 2513 | 733.22 | PP |
| 52.8 | 2912 | 993.96 | PP |
| 52.5 | 3100 | 1120.04 | PP |

Test 3

Test 3 evaluated a repaired armor system configured as a Kevlar jacket with ceramic armor against 5.56 mm Ball munitions. Table 3 below provides projectile weight in grains, average velocity in feet per second, and calculated energy, in foot-pounds, at impact. "PP" designates Partial Penetration with no spalling and is determined successful in stopping the munitions.

TABLE 6

| 5.56 ball projectile | | | |
|---|---|---|---|
| Projectile Weight (Grains) | Velocity Average (ft/sec) | Energy (Foot Pounds) | Penetration Description |
| 52.2 | 2548 | 752.35 | PP |
| 52.1 | 2564 | 760.37 | PP |
| 52.0 | 2570 | 762.47 | PP |

Test 4

Test 4 evaluated 2 Ballistic Panels fixed together Back to Front and shot with an M2 Ball Projectile. The weight of the combined panels was 24 psf. Table 7 below provides projectile weight in grains, average velocity in feet per second, and calculated energy, in foot-pounds, at impact. "PP" designates Partial Penetration with no spalling and is determined successful in stopping the munitions.

TABLE 7

| M2 projectile | | | |
|---|---|---|---|
| Projectile Weight (Grains) | Velocity Average (ft/sec) | Energy (Foot Pounds) | Penetration Description |
| 597.2 | 2285 | 6922.22 | PP |

Test 5

Test 5 evaluated Ballistic Panels configured as light armor protecting against 0.50 caliber M2AP munitions. The weight of the panel was 22 psf. Table 8 below provides projectile weight in grains, average velocity in feet per second, and calculated energy, in foot-pounds, at impact. "CP" designates Complete Penetration and is determined as unsuccessful in stopping the munitions.

TABLE 8

| M2AP projectile | | | |
|---|---|---|---|
| Projectile Weight (Grains) | Velocity Average (ft/sec) | Energy (Foot Pounds) | Penetration Description |
| 695.5 | 3074 | 14590.10 | CP |
| 695.3 | 3058 | 14434.46 | CP |

Test 6

Test 6 evaluated Ballistic Panels configured as light armor protecting against 0.50 caliber M2AP munitions. Table 9 below provides projectile weight in grains, average velocity in feet per second, and calculated energy, in foot-pounds, at impact. "PP" designates Partial Penetration with no spalling and is determined successful in stopping the munitions.

TABLE 9

| M2AP projectile | | | |
|---|---|---|---|
| Projectile Weight (Grains) | Velocity Average (ft/sec) | Energy (Foot Pounds) | Penetration Description |
| 695.6 | 2440 | 9193.74 | PP |
| 693.3 | 2560 | 10086.82 | PP |
| 691 | 2671 | 10944.07 | PP |

Test 7

Test 7 evaluated a repaired ballistic panel against 0.50 cal M2AP munitions. The weight of the repaired panel remained 22 psf. Table 10 below provides projectile weight in grains, average velocity in feet per second, and calculated energy, in foot-pounds, at impact. "PP" designates Partial Penetration with no spalling and is determined successful in stopping the munitions.

TABLE 10

| M2AP projectile | | | |
|---|---|---|---|
| Projectile Weight (Grains) | Velocity Average (ft/sec) | Energy (Foot Pounds) | Penetration Description |
| 696.2 | 3075 | 14614.28 | PP |

Test 8

Test 8 evaluated ballistic panels configured as light armor protecting against 0.50 caliber M2AP munitions. Table 11 below provides projectile weight in grains, average velocity in feet per second, and calculated energy, in foot-pounds, at impact. "PP" designates Partial Penetration with no spalling and is determined successful in stopping the munitions.

TABLE 11

| M2AP projectile | | | |
|---|---|---|---|
| Projectile Weight (Grains) | Velocity Average (ft/sec) | Energy (Foot Pounds) | Penetration Description |
| 689.1 | 2756 | 11619.67 | PP |
| 688.5 | 2756 | 11609.56 | PP |

Test 9

Test 9 evaluated a repaired Ballistic Panel against 50 caliber M2AP munitions. Table 12 below provides projectile weight in grains, average velocity in feet per second, and calculated energy, in foot-pounds, at impact. "PP" designates Partial Penetration with no spalling and is determined successful in stopping the munitions.

TABLE 12

| M2AP projectile | | | |
|---|---|---|---|
| Projectile Weight (Grains) | Velocity Average (ft/sec) | Energy (Foot Pounds) | Penetration Description |
| 690.4 | 3026 | 14034.34 | PP |
| 693.1 | 3092 | 14710.52 | PP |

Test 10

Test 10 evaluated a repaired Ballistic Panel against 50 caliber M2 Ball munitions. Table 13 below provides projectile weight in grains, average velocity in feet per second, and calculated energy, in foot-pounds, at impact. "PP" designates Partial Penetration with no spalling and is determined successful in stopping the munitions.

TABLE 13

| M2AP projectile | | | |
|---|---|---|---|
| Projectile Weight (Grains) | Velocity Average (ft/sec) | Energy (Foot Pounds) | Penetration Description |
| 647.9 | 3064 | 13503.26 | PP |
| 646.1 | 3072 | 13536.16 | PP |
| 646.0 | 3172 | 14429.53 | PP |

CONCLUSIONS

With the exception of Test 5, all test items provided the predicted level of protection for the munitions fired. Post-test analysis indicates the test panel of test 5 may have been defective.

When analyzed using straight energy calculations, individual body armor experienced a maximum of 2,290.37 ft/lbs when subjected to impacts from 7.62 mm projectiles.

In stopping a 7.62 mm×63 mm (30.06 Springfield), based on an NIJ Standard 10.7 gram (165 grain) projectile, energy levels of 2,871 ft/lbs. must be managed. The present armor system was subjected to energy levels in excess of 14,000 ft/lbs. without failure suggesting attacks from the 7.62 mm×63 mm to be manageable.

Post impact analysis of the present armor system subjected to 0.50 caliber impacts suggests that this armor system should be expected to protect against the 20 mm FSP since the tested design experienced only Partial Penetration w/no spalling at 14,000 ft/lbs when tested against the 0.50 caliber AP munitions.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. An armor system comprising an array of pellets, each having a pellet body and four finger-like projections extending radially outwardly from said pellet body, each of said four finger-like projections of a pellet being capable of contacting three finger-like projections of adjacent pellets when arranged in a single layer array for maximizing a contact area between adjacent pellets, wherein each of said pellets is capable of independent side to side movement within said array and is further capable of independently pitching with respect to a surface of said array in response to a projectile impact on a finger-like projection of said four finger-like projections.

2. The armor system pellet of claim 1, wherein said maximizing a contact area between adjacent pellets maximizes a transfer of an impact force of said projectile from said pellet to said adjacent pellets.

3. The armor system pellet of claim 1, being composed of a ceramic material.

4. The armor system pellet of claim 3, wherein said ceramic material includes a material selected from the group consisting of alumina, boron carbide, boron nitride, silicon carbide, silicon nitride, and zirconium oxide.

5. The armor system pellet of claim 1, wherein a front surface of the pellet is convex.

6. The armor system pellet of claim 5, wherein a front surface of each of said four finger-like projections is convex.

7. The armor system pellet of claim 1, wherein a largest diameter of the pellet exceeds a largest height thereof.

8. The armor system of claim 1, further comprising front and back plates sandwiching said array.

9. The armor system of claim 8, further comprising a polymer resin disposed between said array and said front and/or back plates.

10. The armor system of claim 9, wherein each of said pellets is capable of said independent side to side movement with respect to said polymer resin.

11. The armor system of claim 8, further comprising a flexible support structure for securing said array to said front and/or back plates.

12. The armor system of claim 11, further comprising connectors for interconnecting said front and back plates through said support structure.

13. The armor system of claim 8, further comprising a shock absorbing layer disposed between said front and back plates.

14. The armor system of claim 8, wherein each of said pellets is capable of said independent side to side movement with respect to said front and back plates sandwiching said array.

15. The armor system of claim 1, comprising at least two layers of said array.

16. The armor system of claim 1, further comprising a high tensile strength fabric disposed around said array.

17. The armor system of claim 16, wherein said fabric includes carbon fibers, fiberglass fibers, aramid fibers and/or metallic fibers.

18. The armor system of claim 1, configured as body armor.

19. The armor system of claim 1, configured as vehicle armor.

* * * * *